US006427845B1

(12) United States Patent
Buer

(10) Patent No.: US 6,427,845 B1
(45) Date of Patent: Aug. 6, 2002

(54) APPARATUS FOR SEPARATING PLASTIC BAGS FROM CANS AND/OR BOTTLES

(75) Inventor: Jeffrey J. Buer, Norwalk, IA (US)

(73) Assignee: MidAmerica Recycling Company, Des Moines, IA (US)

( * ) Notice: Subject to any disclaimer, the term of this patent is extended or adjusted under 35 U.S.C. 154(b) by 0 days.

(21) Appl. No.: 09/596,453

(22) Filed: Jun. 19, 2000

(51) Int. Cl.[7] ..... B07C 9/00

(52) U.S. Cl. ..... 209/643; 209/689; 209/919; 209/930; 209/932

(58) Field of Search ..... 209/643, 44.2, 209/644, 686, 689, 919, 930, 932

(56) References Cited

U.S. PATENT DOCUMENTS 1,328,733 A * 1/1920 Harriss ..... 209/643
2,011,110 A * 8/1935 Lorenzen ..... 209/643
3,587,851 A * 6/1971 Anderson ..... 209/74
4,824,559 A * 4/1989 Gilmore et al. ..... 209/23
5,203,665 A * 4/1993 Lande ..... 414/412
6,241,097 B1 * 6/2001 Roman ..... 209/3
6,279,748 B1 * 8/2001 Nakamura et al. ..... 209/3

* cited by examiner

*Primary Examiner*—Donald P. Walsh
*Assistant Examiner*—Joseph C Rodriguez
(74) *Attorney, Agent, or Firm*—Henderson & Sturm LLP

(57) ABSTRACT

A method and apparatus for separating cans or bottles from plastic bags and plastic bag parts, including a frame and a perforated drum operably rotatably attached to the frame. The drum has a circular cross section. A divider member is disposed in the interior of the drum with edges of the divider member being in close proximity to the inside of the drum. A vacuum device is connected to one side of the divider creating a lower pressure section of the drum whereby cans or bottles and plastic bags falling onto the rotating drum causes the plastic bags to attach to the exterior of the drum on the lower pressure section thereof. This allows the plastic bags to be released on the other side of the drum from the pull of the lower pressure as the drum is rotated, by having a low pressure and high pressure side of the drum.

16 Claims, 5 Drawing Sheets

APPARATUS FOR SEPARATING PLASTIC BAGS FROM CANS AND/OR BOTTLES

ROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF INVENTION

1. Field of Application

This invention relates to a method and apparatus for separating materials, and more particularly to such an apparatus designed to separate plastic bags in which cans or bottles are stored from the bags themselves when such bags are opened to remove the cans and/or bottles therefrom.

2. Description of the Related Art

When beverage cans or bottles are collected, they are typically put into plastic bags. These plastic bags are then placed into a truck or the like and transported to a facility for separating and collecting like parts for recycling.

There are machines in the prior art which will accept bags of cans or bottles and then automatically rip the bags open so that the cans or bottles can be conveyed onto a separator or the like. The problem to date has been that while the cans and bottles and various parts thereof can be separated by conventional systems, it has been very difficult, and sometimes impossible, to later automatically remove all of the plastic bags or plastic bag parts from such cans and/or bottles.

Consequently, there is a need for an apparatus which will reliably and economically separate the plastic bags and plastic bag parts from cans or bottles after the bags of cans or bottles have been opened, especially by the automated equipment designed to open such bags of cans or bottles.

BRIEF SUMMARY OF THE INVENTION

The present invention relates to an apparatus for separating cans or bottles from plastic bags and plastic bag parts, including a frame and a perforated drum operably rotatably attached to the frame. The drum has a circular cross section.

A divider member is disposed in the interior of the drum with edges of the divider member being in close proximity to the inside of the drum. A vacuum device is connected to one side of the divider creating a lower pressure section of the drum whereby cans or bottles, plastic bags and plastic bag parts falling onto the rotating drum causes the plastic bags and parts thereof to attach to the exterior of the drum on the lower pressure section thereof while the cans and bottles do not so attach. This allows the plastic bags to be released on the other side of the drum from the pull of the lower pressure as the drum is rotated, by having a low pressure and high pressure side of the drum.

An object of the present invention is to provide an improved separator for separating cans or bottles from plastic bags in which such cans or bottles are transported from place to place.

Another object of the present invention is to provide a separator which utilizes a divider and a vacuum device to hold plastic bags against the one side of the drum and a higher pressure side of the drum permitting the plastic bags to fall off and be collected.

A still further object of the present invention is to provide a separator of the aforementioned type which uses both the vacuum side and pressure side of a blower to hold plastic bags to one side of a drum by utilizing the vacuum of the blower and using the higher pressure side of the blower to blow plastic bags and plastic bag parts off of such other side of the drum.

Other objects, advantages, and novel features of the present invention will become apparent from the following detailed description of the invention when considered in conjunction with the accompanying drawings.

DETAILED DESCRIPTION OF THE INVENTION

Figure 1:
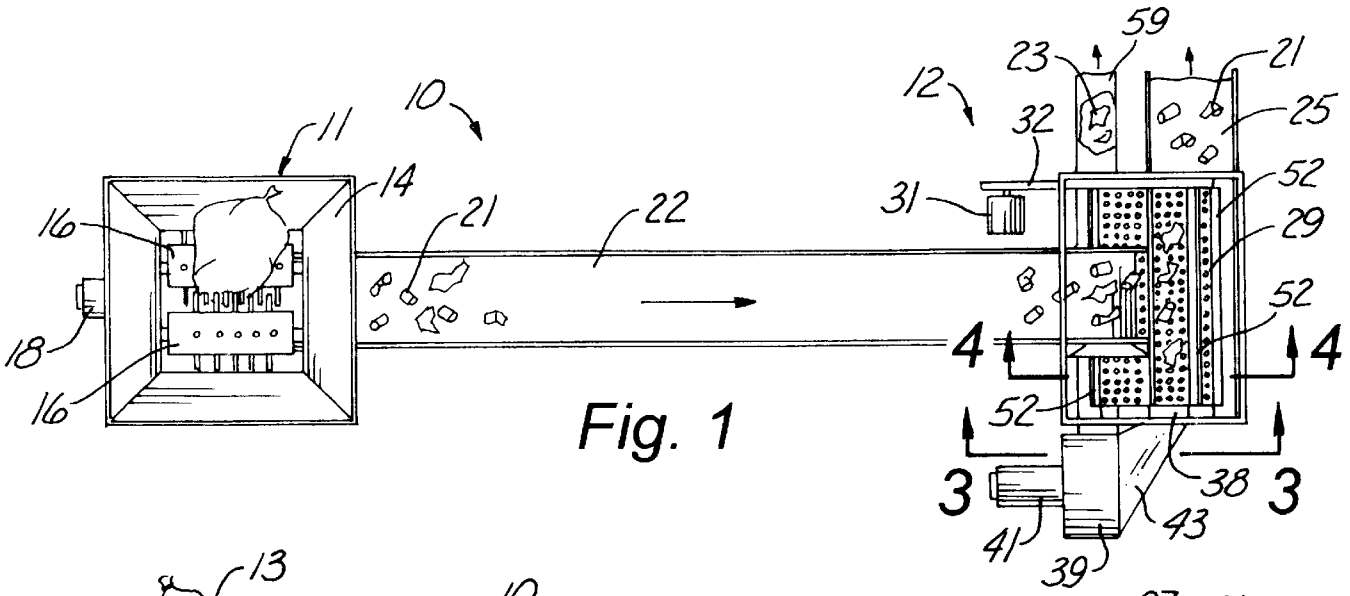
FIG. 1 is a top plan view of the separator of the present invention.

Referring now to the drawings wherein like reference numerals designate identical or corresponding parts throughout the several views, FIG. 1 shows the an apparatus (10) constructed in accordance with the present invention and including a prior art device (11) for tearing open bags of cans or bottles and a novel separator (12) for separating the cans and bottles from the plastic bags and parts of the plastic bags.

Figure 2:
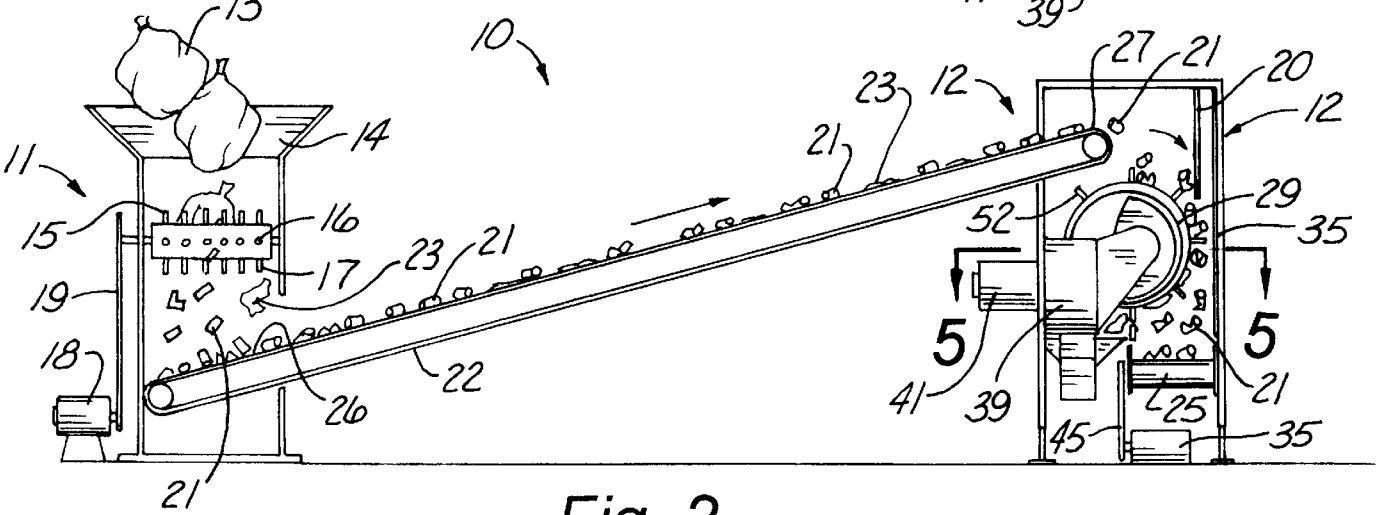
FIG. 2 shows a side elevational view of the present invention in cross section.

Looking to FIGS. 1 and 2, plastic bags (13) are placed inside a hopper portion (14) of the bag opening device (11) and a pair of rotors (16) having teeth (17) thereon are rotated by an electric motor (18) and belt and pulley system (19). By having the two rotors rotating in the same direction but at different speeds, the teeth (15) can move downwardly on the inside where the rotors are adjacent each other and this will pull the bags (13) between the rollers (16) and cause the bags (13) to be ripped open and causing the cans or bottles (21) to fall onto a powered conveyor belt (22) along with plastic bag portions (23).

The conveyor (22) has an inlet portion (26) and an outlet portion (27) disposed above the separator (12).

Still referring to FIG. 2, the separator (12) has a frame (35) with mounting rollers (28) attached thereto for rotatably mounting a drum (29). The drum is rotated by an electric motor (31) shown in FIG. 1 and a pulley and belt system (32).

Figure 3:
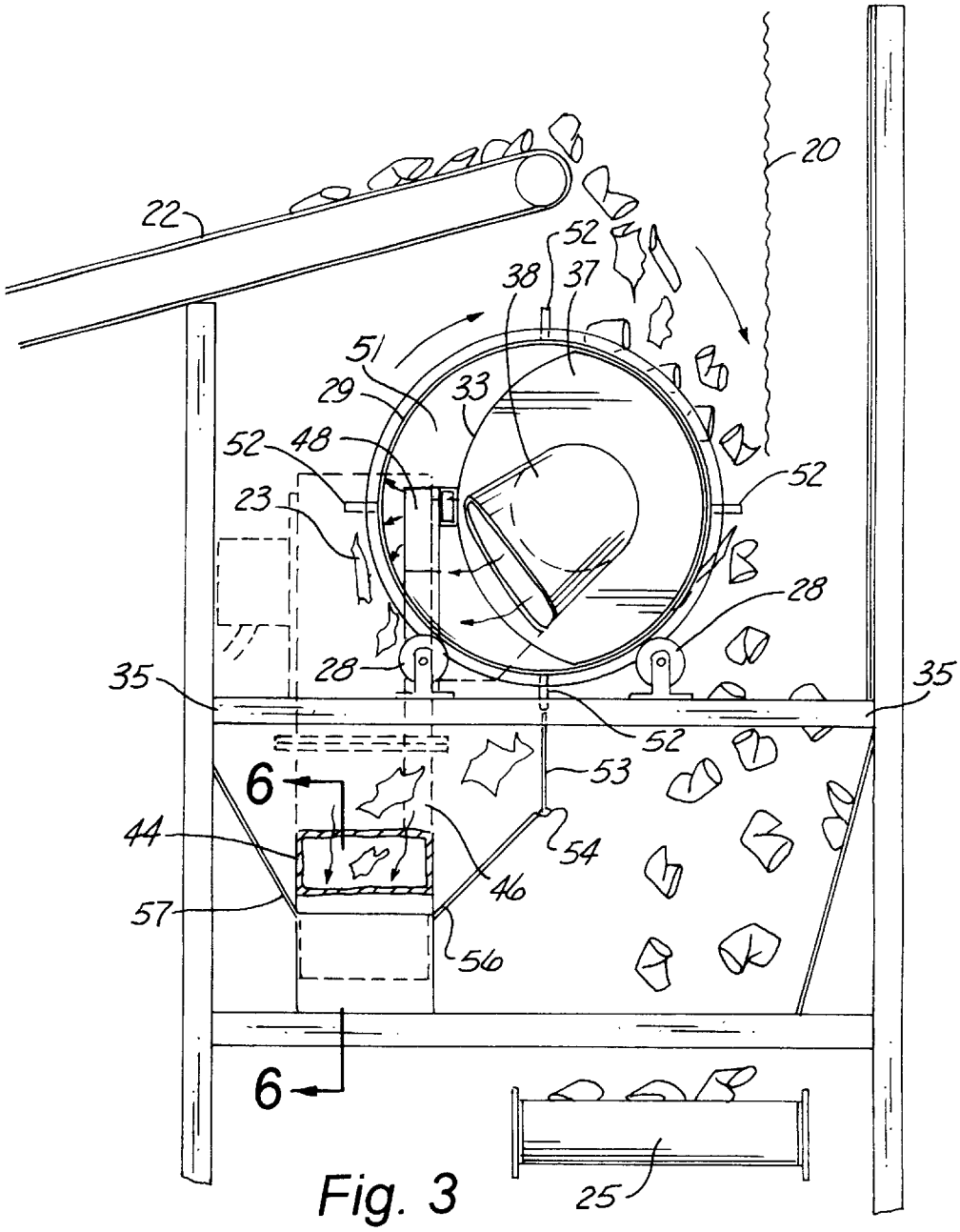
FIG. 3 is an enlarged cross sectional view taken along line 3—3 of FIG. 1.
Figure 4:
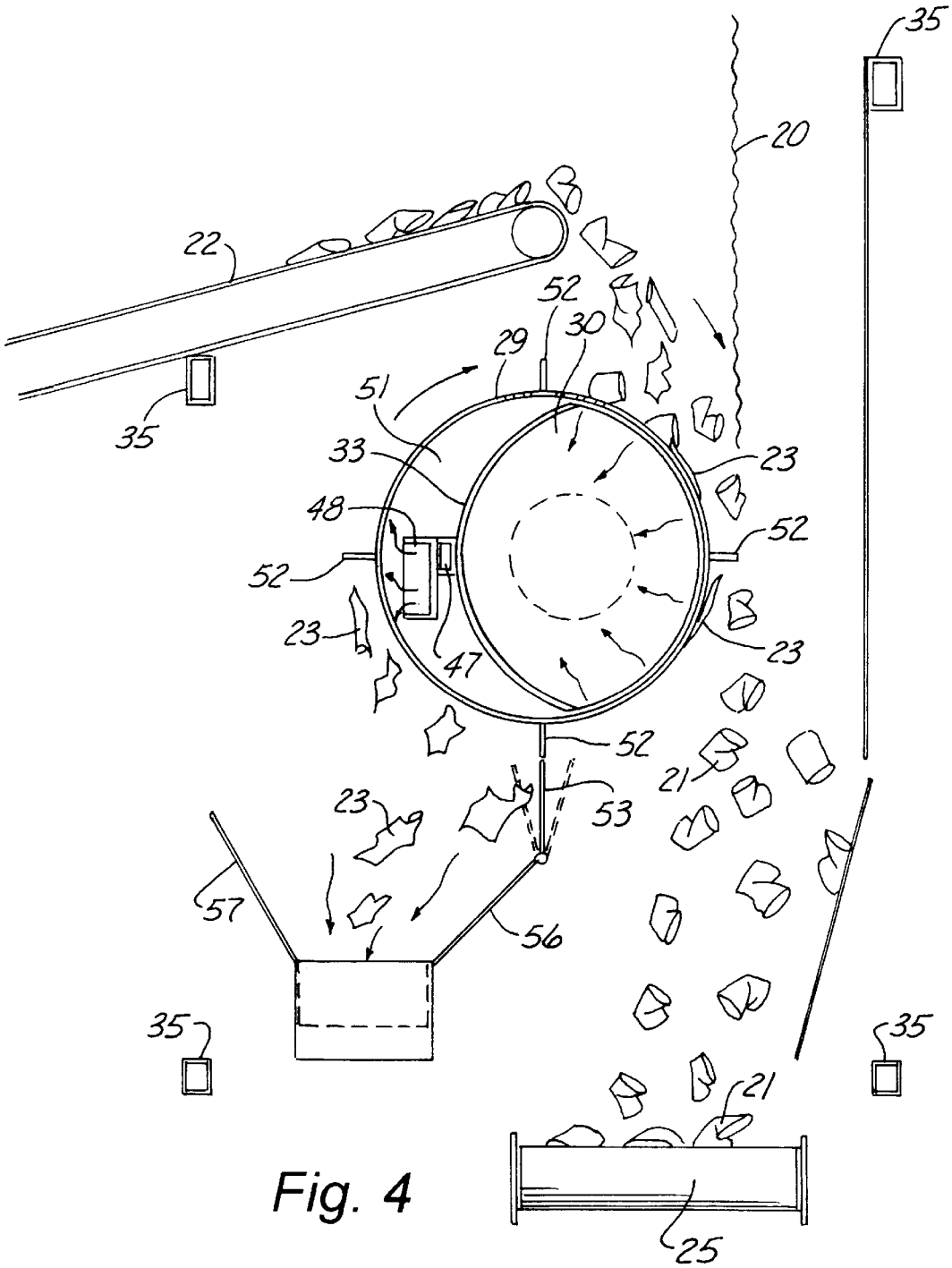
FIG. 4 is an enlarged partial cross sectional view taken along line 4—4 of FIG. 1.
Figure 7:
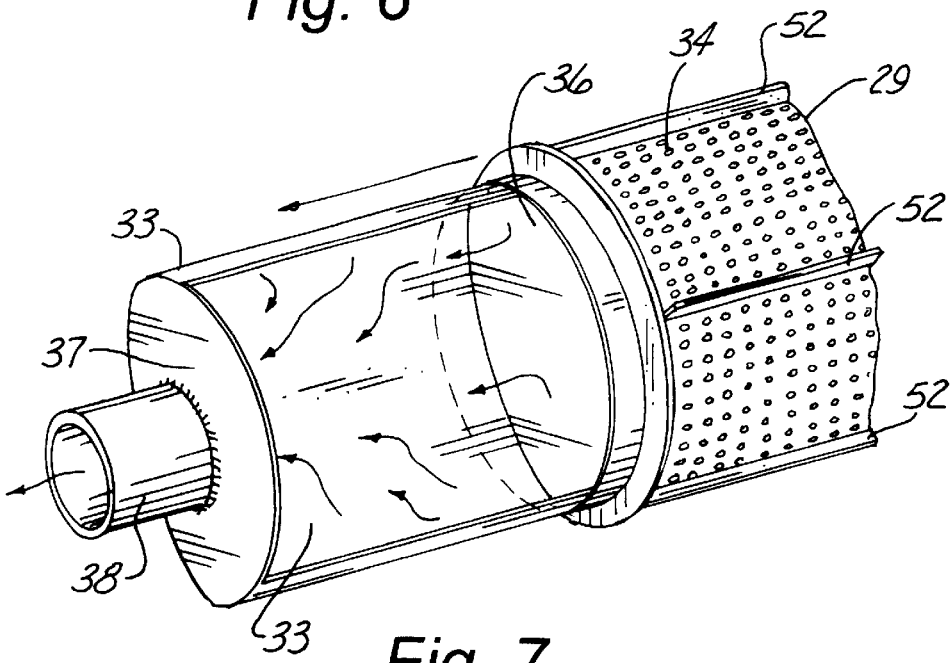
FIG. 7 is an exploded partial perspective view of the divider and the perforated drum.

A divider (33) as can best be seen in FIGS. 3 and 4 is mounted to be stationarily disposed inside of the drum (29) which is perforated as shown by small holes (34) shown in FIG. 7, for example. The divider (33) has end portions (36) and (37) and a conduit (38) which leads to a blower (39) as can readily be seen in FIGS. 2 and 5.

Figure 5:
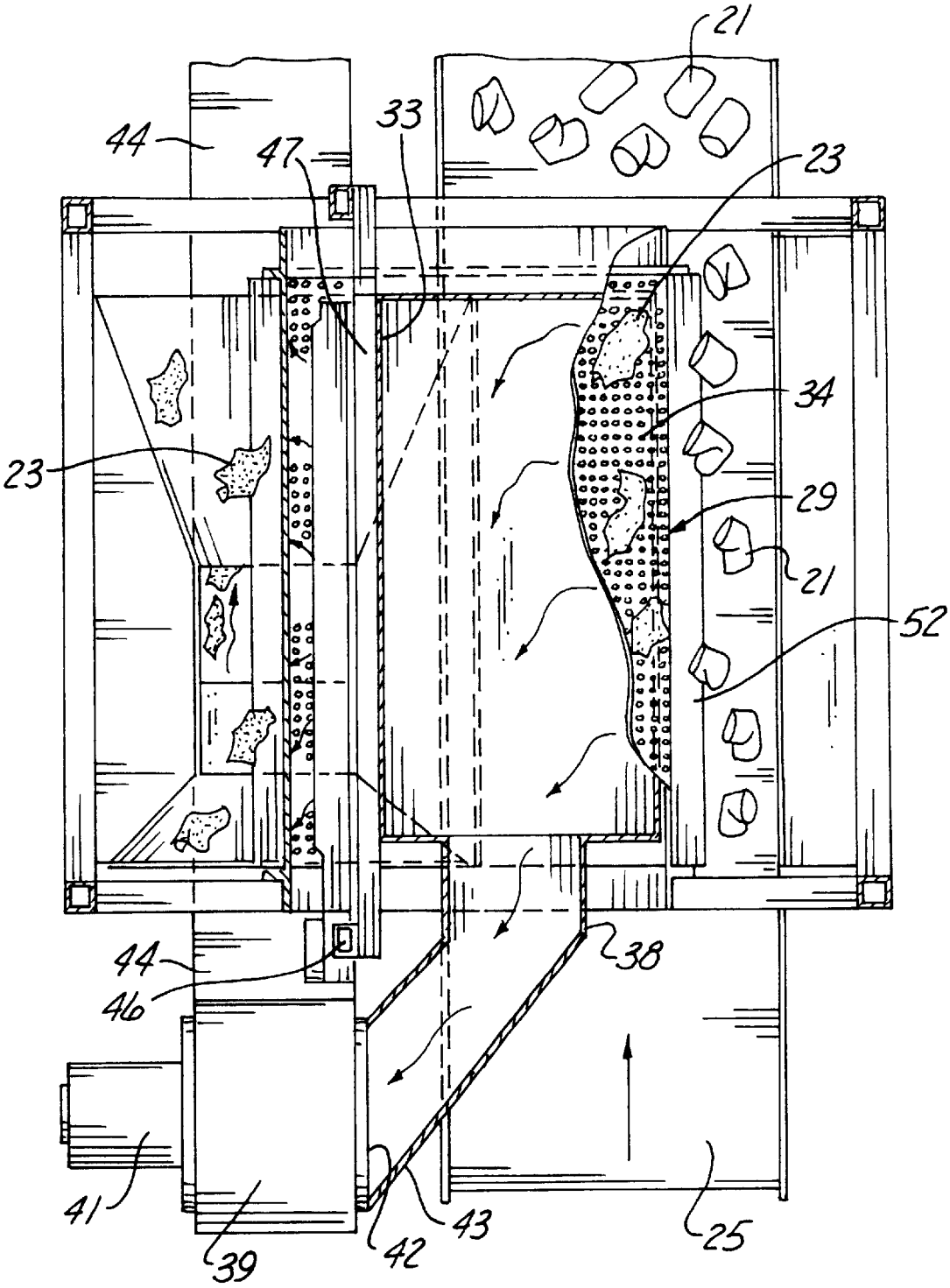
FIG. 5 is an enlarged cross sectional view taken along line 5—5 of FIG. 2.

The blower (39) is powered by another electric motor (41) and the conduit (38) leads to the blower inlet (42) by another conduit (43). The high pressure side of the blower (39) is shown in duct work (44). This duct work (44) also has a duct work passageway (46) on this high pressure side of the blower (39) which leads upwardly at passageway (46) as shown in FIG. 5 and then over along and attached to the divider wall (33) by a horizontal duct work passage (47) which has openings therein to allow air to blow out thereof at part (48) to cause a higher pressure in the high pressure side (51) of the chamber inside drum (29). This air blows plastic bag parts (23) off of the outside of the drum (29) as best shown in FIGS. 3 and 4.

The outside of the perforated drum (29) has flexible rubber flaps (52) thereon for reasons which will be explained below. A movable partition wall (53) is pivoted along horizontal axis (54) at the top of hopper wall (56) which is the other side of hopper wall (57) as shown in FIG. 3. FIG. 4 shows how this partition wall (53) can be adjusted to one of the dashed line positions shown in FIG. 4 if desired to fine-tune the system. This pivoting can also be used to prevent the flaps (52) from jamming something large between it and the partition wall (53).

Figure 6:
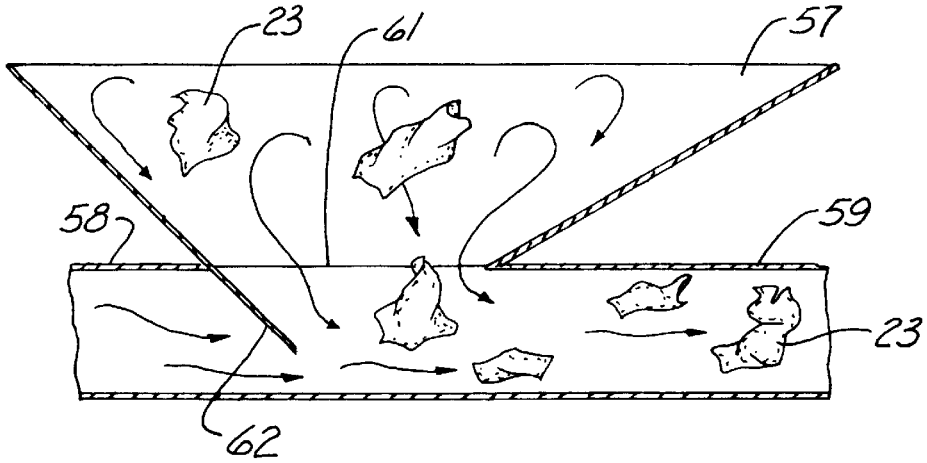
FIG. 6 is an enlarged cross sectional view taken along line 6—6 of FIG. 3.

FIG. 6 shows a venturi arrangement wherein the inlet duct (58) is connected to the high pressure duct work (44) of the blower (39) and this high pressure air travels the direction of the arrows within the inlet of the duct (58) to the outlet of the duct (59). The tapered hopper walls (57) catch the pieces of plastic bag (23) and by gravity cause them to move downwardly to opening (61) at the bottom thereof. By having an extended venturi wall (62), the high pressure air passing from inlet (58) to inlet (59) actually pulls air downwardly in the hopper (57) and sucks the pieces of plastic bag (23) downwardly and into the tube and outlet (59) thereof.

In operation, plastic bags full of cans or bottles which have been collected somewhere, such as in a grocery store, are taken from a truck or the like and placed into a hopper (14) of the device (11) for opening and separating the bags from the cans or bottles (21). With the motor (18) running, the rotors (16), having teeth (15) thereon as shown in FIGS. 1 and 2, will rip open the plastic bags (13) and cause the cans or bottles (21) to fall onto the conveyor (22).

The conveyor (22) delivers the cans or bottles (21) to the top of the rotating drum (29) of separator (12). The top or outlet of the conveyor (22) is long enough so that the cans or bottles go beyond the midpoint of the drum and therefore always go on the right side as viewed in FIG. 2.

A curtain (20) hangs from the frame (27) to keep the cans (21) and plastic pieces (23) close to the drum (29) as they fall downwardly. This ensures that the plastic bag pieces (23) will be close enough to the drum (29) such that suction from the inlet side of the blower (39) will be pulling inwardly as can best be seen in FIG. 4 to hold the plastic bag portions (23) against the outside of the perforated drum. The cans or bottles (21) will therefore fall downwardly and onto a conveyor (25), while at the same time the pieces of plastic bag (23) will stay attached to the drum (29) until such time that they pass the partition (53) and/or on the high pressure side of the drum (29).

At the same time that the blower is applying a vacuum to the chamber (30) of the drum (29) a higher than atmospheric pressure is present on the chamber side (51) of the drum (29) by virtue of having the high pressure side of the blower through duct work (44), (46), (47) and (48) which blows the plastic bag portions (23) away from the drum (29) and these pieces (23) fall into the hopper (57).

Since the high pressure side (58) as shown in FIG. 6 also is blowing pressurized air therethrough, the venturi affect of member (26) in the duct work (58) and (59) causes turbulence and sucks air and plastic bag parts (23) out the outlet end of the duct (59) where it can also be collected for recycling. The conveyor (25) which is disposed as shown in FIGS. 2, 3 and 4 accepts the cans and bottles (21) and the conveyor motor (35) and pulley and belt system (45) conveys the cans or bottles (21) to a place where they can be collected.

Rubber flaps (52) continuously wipe plastic bag portions (23) to the left of partition wall (53) as shown in FIG. 3 rather than allowing bag portions (23) to gather on the right side with the cans or bottles (21). Rubber flaps (52) are optional.

Accordingly, it will be appreciated that the preferred embodiment shown herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. Apparatus for separating cans from plastic bag parts comprising:

a frame;

a perforated drum operably rotatably attached to said frame for rotation in at least one rotary direction about a fixed axis, said drum having a circular cross section, an interior, an exterior having a dynamically upwardly moving half and a dynamically downwardly moving half, and ends;

a divider member disposed in the interior of said drum, edges of said divider member being in close proximity to the interior of said drum;

a conveyor having beverage cans and plastic bag parts thereon, said conveyor having a discharge portion means completely above the drum for discharging said cans and plastic bag parts only onto said downwardly moving half; and a vacuum device connected to one side of said divider creating a lower pressure section on at least a portion of the downwardly moving half said drum whereby said cans and plastic bag parts falling from said conveyor discharge portion means onto said rotating drum causes the plastic bag parts to attach to the exterior of the downwardly moving half said drum on said lower pressure section thereof and allows the plastic bag parts to be released from a pull of said lower pressure when the plastic bag parts are disposed on the exterior of at least a portion of the upwardly moving half of the drum on the other side of said divider.

2. The apparatus of claim 1 including a partition disposed below said drum for permitting cans and bottles to be collected on one side thereof and plastic bag parts to be collected on the other side thereof.

3. The apparatus of claim 2 wherein said partition is adjustably below said drum.

4. The apparatus of claim 3 including a plurality of flexible flaps longitudinally disposed on the exterior of said drum, each respective flap mating with said partition as to wipe any bag parts into the other side of the partition.

5. The apparatus of claim 1 including an entry point of cans, bottles and plastic bags above the lower pressure side of said drum.

6. The apparatus of claim 4 wherein a curtain is disposed above and adjacent to the lower pressure side of the drum for directing the flow of cans, bottles and bags close to said lower pressure side of the drum.

7. The apparatus of claim 5 including a conveyor having an inlet end and an outlet at said entry point.

8. The apparatus of claim 7 including a rotor with teeth for tearing open plastic bags full of cans or bottles disposed above said inlet end of said conveyor.

9. The apparatus of claim 1 including means for creating a higher than atmospheric pressure on the other side of said divider member on the inside of said another section of said drum.

10. The apparatus of claim 1 wherein said vacuum device includes a blower having a pressure side and a vacuum side;

said vacuum side of the blower being operatively attached to said one side of said divider to cause plastic bags to attach to the outside of said lower pressure section of said drum and the pressure side of the blower being connected to the inside of said another section of the drum for pushing plastic bags away from the exterior of the drum on said another section thereof.

11. The apparatus of claim 10 including a collection hopper for collecting plastic bag portions below said another section of the drum; an outlet opening disposed in the bottom of said hopper; a pressure conduit operatively connected on one end thereof to the pressure side of said blower; a venturi disposed below said outlet opening, said venturi connected to said one end of the pressure conduit and to another end of said pressure conduit for sucking plastic bag parts from said outlet opening and forcing said plastic bag parts toward said another end of said pressure conduit.

12. The apparatus of claim 1 wherein said divider member includes a center portion extending across the interior of the drum and side portions adjacent to the ends of the drum.

13. The apparatus of claim 12 wherein said vacuum device is operatively attached to one of said side portions of said divider member.

14. A method for separating cans or bottles from plastic bags utilizing a frame;

a perforated drum operably rotatably attached to said frame for rotation in at least one rotary direction about a fixed axis, said drum having a circular cross section, an interior, an exterior having a dynamically upwardly moving half and a dynamically downwardly moving half, and ends;

a divider member disposed in the interior of said drum, edges of said divider member being in close proximity to the interior of said drum;

a conveyor having beverage cans and plastic bag parts thereon, said conveyor having a discharge portion means completely above the drum for discharging said cans and plastic bag parts only onto said downwardly moving half; and a vacuum device connected to one side of said divider creating a lower pressure section on at least a portion of the downwardly moving half said drum whereby said cans and plastic bag parts falling from said conveyor discharge portion means onto said rotating drum causes the plastic bag parts to attach to the exterior of the downwardly moving half said drum on said lower pressure section thereof and allows the plastic bag parts to be released from a pull of said lower pressure when the plastic bag parts are disposed on the exterior of at least a portion of the upwardly moving half of the drum on the other side of said divider, said method comprising dropping a combination of at least two items of which are cans, bottles and plastic bag parts onto a top portion of the lower pressure side of said perforated drum;

collecting the heavier of the two items below said lower pressure side of the perforated drum; and collecting the plastic bag parts below said another side of the drum.

15. The method of claim 14 including transporting said heavier of the two items to a place for recycling.

16. The method of claims 14 and 15 including transporting said plastic bag parts to another place for recycling.

* * * * *